US011414160B2

(12) United States Patent
Bangslund

(10) Patent No.: US 11,414,160 B2
(45) **Date of Patent: *Aug. 16, 2022**

(54) TUGBOAT

(71) Applicant: Svitzer A/S, Copenhagen (DK)

(72) Inventor: Thomas Bangslund, Ølstykke (DK)

(73) Assignee: Svitzer A/S, Copenhagen K (DK)

( * ) Notice: Subject to any disclaimer, the term of this patent is extended or adjusted under 35 U.S.C. 154(b) by 164 days.

This patent is subject to a terminal disclaimer.

(21) Appl. No.: 16/879,402

(22) Filed: May 20, 2020

(65) Prior Publication Data

US 2020/0277025 A1 Sep. 3, 2020

Related U.S. Application Data

(63) Continuation of application No. PCT/EP2018/081818, filed on Nov. 19, 2018.

(30) Foreign Application Priority Data

Nov. 20, 2017 (GB) ..... 1719228

(51) Int. Cl.

| | |
|---|---|
| ***B63B 21/04*** | (2006.01) |
| ***B63B 21/56*** | (2006.01) |
| ***B63B 35/68*** | (2006.01) |
| ***B66D 3/00*** | (2006.01) |

(52) U.S. Cl.

CPC ..... *B63B 21/04* (2013.01); *B63B 21/56* (2013.01); *B63B 35/68* (2013.01); *B66D 3/006* (2013.01); *B63B 2021/566* (2013.01)

(58) Field of Classification Search

CPC ..... B63B 21/04; B63B 21/56; B63B 35/68; B63B 2120/566; B66D 3/006

See application file for complete search history.

(56) References Cited

U.S. PATENT DOCUMENTS

| | | | |
|---|---|---|---|
| 3,280,784 | A | 10/1966 | Stainbrook |
| 3,507,243 | A | 4/1970 | Brown |
| 3,588,051 | A | 6/1971 | Leeming |
| 4,095,548 | A | 6/1978 | Bruner |
| 4,173,194 | A | 11/1979 | McLaughlin |

(Continued)

FOREIGN PATENT DOCUMENTS

| | | | |
|---|---|---|---|
| CN | 102438886 | A | 5/2012 |
| CN | 104677488 | A | 6/2015 |

(Continued)

OTHER PUBLICATIONS

United Kingdom Combined Search and Examination Report dated May 9, 2018 for GB Application No. 1719228.7.

(Continued)

*Primary Examiner* — S. Joseph Morano
*Assistant Examiner* — Jovon E Hayes
(74) *Attorney, Agent, or Firm* — EIP US LLP

(57) ABSTRACT

Described is a tugboat 1 for assisting a marine vessel 2 to manoeuvre. The tugboat 1 comprises a hull 11 having a perimeter P. The tugboat 1 also comprises a line handling system 10 comprising a line guide mechanism 100. The line guide mechanism 100 protrudes, or is positionable to protrude, away from the hull 11 for guiding a line 20 of the marine vessel 2 towards a predetermined region R of the perimeter P.

18 Claims, 10 Drawing Sheets

(56) References Cited

U.S. PATENT DOCUMENTS

| | | | | | |
|---|---|---|---|---|---|
| 4,275,677 | A * | 6/1981 | Nelson | B63B 35/68 114/253 |
| 4,706,594 | A * | 11/1987 | Burns | B63B 21/04 24/130 |
| 5,177,937 | A | 1/1993 | Alden | |
| 5,529,010 | A * | 6/1996 | Johnson | B63B 21/58 114/221 R |
| 6,044,787 | A | 4/2000 | Elmbo | |
| 6,354,235 | B1 * | 3/2002 | Davies | B63B 21/56 440/33 |
| 10,279,870 | B2 * | 5/2019 | Butler, III | B63B 21/10 |
| 2006/0102060 | A1 * | 5/2006 | Vila Boixadera | B63B 21/04 114/254 |
| 2011/0030605 | A1 | 2/2011 | Carlson | |
| 2011/0278520 | A1 | 11/2011 | Ingeberg | |
| 2012/0037240 | A1 * | 2/2012 | Adkins | B63B 21/507 137/15.09 |
| 2020/0277025 | A1 | 9/2020 | Bangslund | |
| 2020/0277026 | A1 | 9/2020 | Bangslund | |
| 2020/0283099 | A1 | 9/2020 | Bangslund | |

FOREIGN PATENT DOCUMENTS

| | | | | |
|---|---|---|---|---|
| DE | 1511817 | A1 | 8/1969 | |
| EP | 0124947 | A1 | 11/1984 | |
| EP | 0176189 | A1 | 4/1986 | |
| EP | 0672582 | A | 9/1995 | |
| EP | 1535831 | A1 | 6/2005 | |
| ES | 1023207 | * | 10/1992 | B63B 21/56 |
| ES | 1023207 | U | 6/1993 | |
| FR | 2372070 | A1 | 6/1978 | |
| GB | 340712 | A | 1/1931 | |
| GB | 891007 | A | 3/1962 | |
| GB | 990994 | A | 5/1965 | |
| GB | 1256090 | A | 12/1971 | |
| GB | 1495040 | A | 12/1977 | |
| GB | 2217961 | A | 11/1989 | |
| JP | S50017994 | U | 2/1975 | |
| JP | S58177275 | A | 10/1983 | |
| JP | S6018081 | A | 1/1985 | |
| JP | S60119690 | U | 8/1985 | |
| JP | S61057485 | A | 3/1986 | |
| JP | S63121589 | A | 5/1988 | |
| JP | H0232918 | A | 2/1990 | |
| JP | H0725751 1 | A | 10/1995 | |
| JP | 2002046687 | A | 2/2002 | |
| JP | 2002046688 | A | 2/2002 | |
| JP | 2003041775 | A | 2/2003 | |
| JP | 2005254878 | A | 9/2005 | |
| KR | 200251715 | Y1 | 2/2002 | |
| KR | 101527836 | B1 | 6/2015 | |
| NL | 1010650 | C1 | 5/2000 | |
| NO | 341050 | B1 | 8/2017 | |
| WO | 9711876 | A | 4/1997 | |
| WO | 9711876 | A1 | 4/1997 | |
| WO | 0055034 | A1 | 9/2000 | |
| WO | WO-2007021195 | A1 * | 2/2007 | B63B 21/04 |
| WO | 2009059445 | A1 | 5/2009 | |
| WO | 2010097426 | A1 | 9/2010 | |
| WO | 2017055140 | A1 | 4/2017 | |
| WO | 2017167884 | A1 | 10/2017 | |
| WO | 2017167892 | A1 | 10/2017 | |
| WO | 2019185984 | A1 | 10/2019 | |
| WO | 2021009233 | A1 | 1/2021 | |

OTHER PUBLICATIONS

United Kingdom Examination report dated Feb. 10, 2020 for GB Application No. 1719228.7.

International Search Report and Written Opinion dated Jan. 31, 2019 for PCT Application No. PCT/EP2018/081818.

Australian Examination reported dated Mar. 1, 2021 for Australian Patent Application No. 2018368627.

Japanese Office Action dated May 28, 2021 for Japanese Application No. 2020-545454.

United Kingdom Examination report dated Feb. 10, 2020 for GB Application No. 1719231.1.

Korean Notice of Preliminary Rejection dated Jul. 18, 2021 for Korean Application No. 10-2020-7017755.

Singapore Search Report and Written Opinion dated Mar. 8, 2021 for Singapore Application No. 11202004713U.

International Search Report and Written Opinion dated Jan. 31, 2019 for PCT Application No. PCT/EP2018/081820.

United States Non-Final Office Action dated Dec. 7, 2021 for U.S. Appl. No. 16/879,437.

Japanese Office action dated Jul. 8, 2021 for Japanese Application No. 2020-545455.

United States Non-Final Office Action dated Dec. 8, 2021 for U.S. Appl. No. 16/879,473.

International Search Report and Written Opinion dated Mar. 15, 2019 for PCT Application No. PCT/EP2018/081821.

Singapore Search Report and Written Opinion dated Mar. 8, 2021 Singapore Application No. 11202004717P.

Wikipedia, 'Seizing', Aug. 19, 2008, http://en.wikipedia.org/wiki/Seizing.

Luce, S. B., Hawsers/Chapter IV., 'Text-book of Seamanship', Jan. 1, 1891, p. 38, https://maritime.org/doc/luce/index.htm.

Singapore Written Opinion dated Jan. 14, 2022, for Singapore Application No. 11202004713U.

European Examination report dated Jun. 28, 2021 for European Application No. 18811466.4.

Japanese Office Action dated Jun. 1, 2021 Japanese Application No. 2020-545453.

* cited by examiner

TUGBOAT

CROSS-REFERENCE TO RELATED APPLICATIONS

This application is a continuation of International Application No. PCT/EP2018/081818, filed Nov. 19, 2018 which claims priority to UK Application No. GB 1719228.7, filed Nov. 20, 2017, under 35 U.S.C. § 119(a). Each of the above referenced patent applications is incorporated by reference in its entirety.

BACKGROUND OF THE INVENTION

Field of the Invention

The present invention relates to tugboats for assisting marine vessels to manoeuvre.

Description of the Related Technology

A tugboat helps to manoeuvre another vessel by pushing or towing the other vessel. For example, the other vessel may not be permitted to move under its own propulsion, such as a container ship in a crowded harbour or a narrow canal, or may be unable to move under its own propulsion, such as a disabled ship.

In order for a tugboat to be able to tow another vessel (such as a container ship), a tow line must extend between, and be secured to, the tugboat and the other vessel. One way of providing this tow line involves the successive exchange of lines of increasing strength (and, usually, diameter) between the vessels. For example, it is known for the end of a heaving line (e.g. of 12-millimetre diameter) to be thrown to the tugboat from the other vessel, such as from the fore or the aft of the other vessel. The end of the heaving line is typically thrown from the other vessel to an able-bodied seaman (AB) on the tugboat, such as on the deck of the tugboat. The AB catches the heaving line and ties it to a messenger line (e.g. of 24-millimetre diameter) that is stored on the tugboat. The messenger line is attached to a tow line (e.g. of 76-millimetre diameter) that is also stored on, and attached to, the tugboat. The heaving line, and thereafter the messenger line and then the tow line, is then pulled up to the other vessel, for example using a capstan of the other vessel. The tow line is then attached to the other vessel, such as by being placed over a bollard on the other vessel. The tugboat is then able to manoeuvre the other vessel using the tow line extending between them.

The heaving line of the other vessel is often lightweight and sensitive to wind, and so it can be difficult to throw the heaving line accurately towards the tugboat. Therefore, it is known to increase the weight of an end of the heaving line to be thrown, such as by tying a large knot (known as a "monkey paw" or a "monkey's fist") in the heaving line. An example monkey's fist knot is shown in FIG. 13. In some cases, additional weight, such metal objects e.g. bolts, is included in the knot to help the end of the heaving line to be thrown accurately. However, this is undesirable, since the AB could be injured if hit by a monkey's fist in the heaving line. Moreover, in extreme cases, the tugboat itself, such as its deck, may be damaged by the impact of a heavy monkey's fist.

Furthermore, conditions at sea or even in large harbours can make it difficult for tugboat crew members to get hold of a line of the tugboat, such as a messenger line, or to align and tie the line of the tugboat to a line of the other vessel, such as a heaving line.

Embodiments of the present invention aim to address the aforementioned problems.

SUMMARY

The present invention provides a tugboat for assisting a marine vessel to manoeuvre, the tugboat comprising: a hull having a perimeter, and a line handling system comprising a line guide mechanism that protrudes, or is positionable to protrude, away from the hull for guiding a line of the marine vessel towards a predetermined region of the perimeter.

Since the line guide mechanism is for guiding the line of the marine vessel towards the predetermined region of the perimeter, it is possible for the line (such as a heaving line) to be thrown towards the line guide mechanism, rather than towards a deck of the tugboat or an AB or other crew member standing on the deck. Accordingly, crew members on the tugboat are less likely to be injured, and the tugboat itself it less likely to be damaged, by a line thrown from the marine vessel.

Optionally, the line handling system comprises a line engager for engaging with the line of the marine vessel when the line of the marine vessel is at the predetermined region of the perimeter.

Optionally, the line guide mechanism comprises at least one guide device, the or each guide device comprising a guide arm that protrudes, or is positionable to protrude, away from the hull.

Optionally, the guide arm is moveable relative to the hull.

Optionally, the guide arm is rotatable relative to the hull. Optionally, the guide arm is rotatable relative to the hull about a pivot point so as to move an end of the guide arm distal to the pivot point towards and away from an axis that extends in a fore and aft direction of the tugboat.

Optionally, the at least one guide device comprises first and second such guide devices. Further optionally, the first and second guide devices are arranged so that the respective guide arms of the first and second guide devices are movable towards and away from each other.

Optionally, the or each guide device comprises a secondary guide that is movable relative to the guide arm of the respective guide device to drive the line along the guide arm of the respective guide device towards the predetermined region of the perimeter.

Optionally, the secondary guide is rotatable relative to the guide arm of the respective guide device to drive the line along the guide arm of the respective guide device towards the predetermined region of the perimeter.

Optionally, the at least one guide device comprises first and second such guide devices arranged so that the respective secondary guides of the first and second guide devices are movable towards each other and relative to the hull.

Optionally, during movement of the respective secondary guides of the first and second guide devices relative to the hull, the secondary guides cross over each other at a cross over point that moves along one or both of the secondary guides.

Optionally, each of the respective secondary guides of the first and second guide devices has a parabolic shape.

Optionally, the guide arm is moveable relative to the hull, and the line guide mechanism comprises a drive mechanism for driving movement of the guide arm relative to the hull.

Optionally, the line guide mechanism comprises a user operable controller for controlling the drive mechanism.

Optionally, the tugboat comprises a drive device for driving movement the secondary guide relative to the hull and the guide arm of the respective guide device.

Optionally, the tugboat comprises a user operable controller for controlling the drive device.

Optionally, the line guide mechanism is movable relative to the hull between a deployed position, at which the line guide mechanism protrudes away from the hull for guiding the line of the marine vessel towards the predetermined region of the perimeter, and a stowed position, at which the line guide mechanism does not protrude away from the hull or protrudes away from the hull to a lesser extent than in the deployed position.

Optionally, the line handling system comprises an actuatable coupling mechanism for coupling the line of the marine vessel to a second line when the line of the marine vessel is at the predetermined region of the perimeter.

Optionally, the actuatable coupling mechanism is for coupling the line of the marine vessel to the second line by applying a connector to the line of the marine vessel and the second line.

Optionally, the line guide mechanism is movable relative to the hull to an operation position, at which the line guide mechanism is for guiding movement of a portion of a line of the tugboat towards the predetermined region of the perimeter.

Optionally, the second line is the line of the tugboat.

Optionally, the line handling system is movable relative to the hull so as to vary the predetermined region of the perimeter towards which the line guide mechanism is able to guide the line of the marine vessel. Further optionally, the line handling system is rotatable relative to the hull about an axis that passes through the hull so as to vary the predetermined region of the perimeter towards which the line guide mechanism is able to guide the line of the marine vessel. Optionally, the axis is substantially parallel to a yaw axis of the tugboat.

BRIEF DESCRIPTION OF THE DRAWINGS

Embodiments of the invention will now be described, by way of example only, with reference to the accompanying drawings, in which.

DETAILED DESCRIPTION OF CERTAIN INVENTIVE EMBODIMENTS

Figure 1:
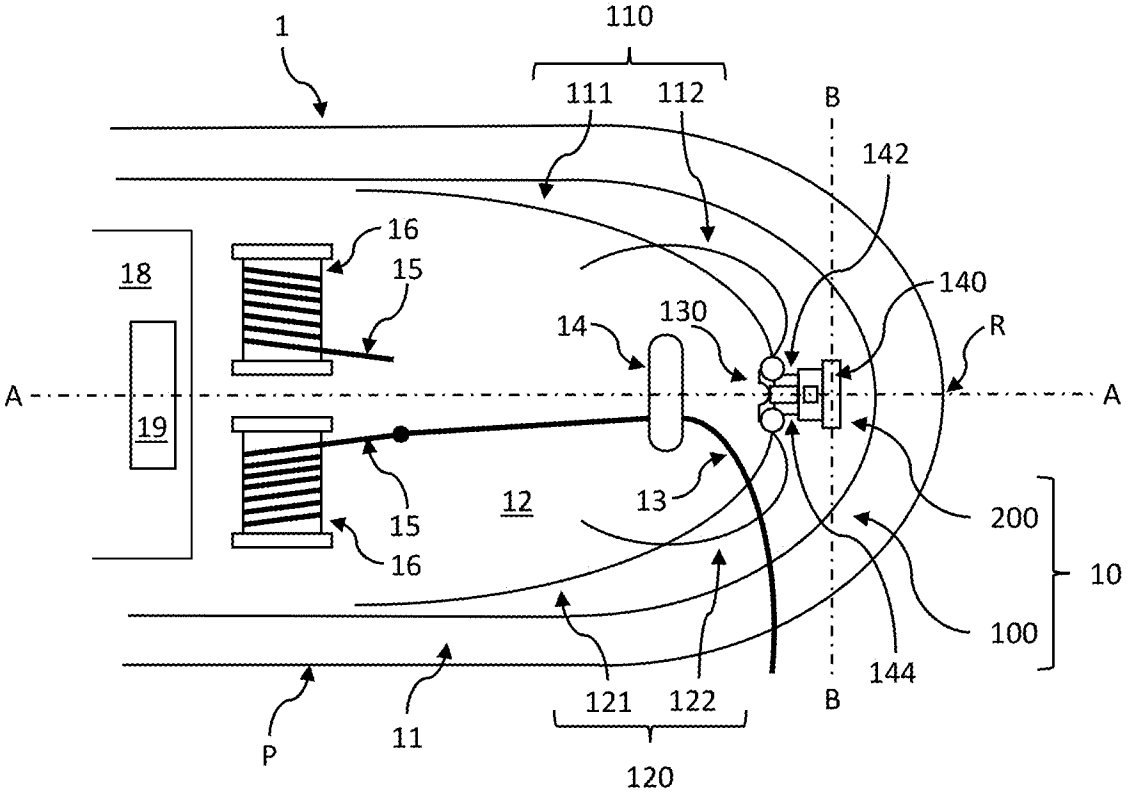
FIG. 1 shows a partial schematic top view of an example of a tugboat according to an embodiment of the present invention, wherein a line guide mechanism of a line handling system of the tugboat is at a stowed position on or adjacent a deck of a hull of the tugboat.

FIG. 1 shows a partial schematic top view of an example of a tugboat 1 according to an embodiment of the present invention. The tugboat 1 is for assisting a marine vessel, such as a container ship, to manoeuvre.

The tugboat 1 includes a hull 11 that has a perimeter P. In some embodiments, at least part of the perimeter P of the hull 11 may be defined by a fender of the tugboat 1, but in other embodiments the fender could be omitted. The tugboat 1 also has a deck 12 within the perimeter P and a wheelhouse 18 on the deck 12. The tugboat 1 further has a pair of line stores 16 for storing lines 15. In this embodiment, each of the line stores 16 is in the form of a winch, but in other embodiments one or other of the line stores 16 could take any other suitable form, such as a spool or any other suitable supply. In this embodiment, the line stores 16 are located on the deck 12, but in other embodiments the line stores 16 could be located elsewhere, such as below deck. In some embodiments, there may be more than two line stores 16, or only one or no line stores 16. In some embodiments, when out of use, the line(s) 15 is/are simply stored on the deck 12 itself.

In this embodiment, the lines 15 stored by the line stores 16 are tow lines 15 (also known in the art as towing lines). The tow lines 15 may be any commercially available tow lines 15, and may be of a synthetic material that is both strong and light enough to float. The tow lines 15 may, for example, have respective diameters of 76 millimetres. Although not shown in the Figures, respective free ends of the tow lines 15 may have an eye, such as a splice eye, for aiding attachment of the free ends of the tow lines 15 to bollards of a marine vessel to be assisted, for example. Further details of the tow lines 15 will not be provided here, for brevity.

The tugboat 1 also carries a further line 13, which in this embodiment is a messenger line 13. The messenger line 13 may, for example, have a diameter of 24 millimetres. The messenger line 13 is for use in the process of hauling a tow line 15 from the tugboat 1 to a marine vessel that is to be assisted by the tugboat 1. In this embodiment, when out of use, the messenger line 13 is stored on the deck 12 itself. However, in other embodiments, the messenger line 13 may be stored elsewhere, such as in a line store on the deck 12 or below deck. In FIG. 1, the messenger line 13 is shown as having a first end coupled to the free end of one of the tow lines 15. For example, when the free end of the tow line 15 has an eye, the first end of the messenger line 13 may be attached to the eye. In other embodiments, the messenger line 13 may not be attached to the tow line 15, or at least not initially.

The opposite, second end of the messenger line 13 is shown in FIG. 1 as hanging or draping over the perimeter P of the hull 11. In this embodiment, the messenger line 13 is provided at the bow end of the tugboat 1. However, due to movement of the tugboat 1 relative to the water in which the tugboat 1 sits, the messenger line 13 has been drawn by the water from the centre of the bow along the starboard side of the tugboat 1 towards the stern. In some embodiments, the messenger line 13 may be discouraged or prevented from moving substantially along the port or starboard side of the tugboat 1 by one or more grooves, ribs or other features provided on the hull, such an on the fender when provided. These features may receive and limit how far from the bow the messenger line 13 is able to move.

The second end of the messenger line 13 may comprise a buoyant element to aid floating of the second end of the messenger line 13. Moreover, in some embodiments, a portion of the messenger line 13 may be coloured so as to be highly visible. This portion of the messenger line 13 may extend for a certain distance (e.g. approximately one metre) from the second end of the messenger line 13. This highly visible portion of the messenger line 13 may help an AB or other member of the crew of the tugboat 1 to identify the position of the messenger line 13, and particularly whether the messenger line 13 is correctly stowed when out of use. In other embodiments, the buoyant element and/or the highly visible portion of the messenger line 13 may be omitted.

In FIG. 1, an intermediate portion of the messenger line 13 is shown to be extending through a bitt or other guide 14 on the deck 12. The bitt or guide 14 helps to guide the messenger line 13, and the tow lines 15 from the line stores 16, in use, and may further be used for attaching one or both of the tow lines 15 securely to the tugboat 1. However, in other embodiments, the messenger line 13 may not be arranged to extend through a bitt or other guide 14, or the bitt or other guide 14 may be omitted. Further details of the messenger line 13 will not be provided here, for brevity.

Figure 2:
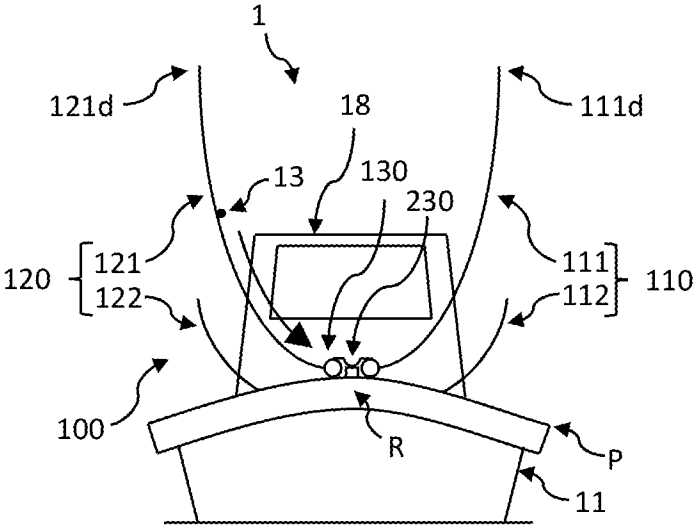
FIG. 2 shows a schematic front view of the tugboat of FIG. 1, wherein the line guide mechanism has been moved to an operation position, at which the line guide mechanism is for guiding a portion of a line of the tugboat towards a predetermined region of a perimeter of the hull.

The tugboat 1 also has a line handling system 10. The line handling system 10 comprises a line guide mechanism 100 that is movable relative to the hull 11 to an operation position, as shown in FIG. 2. At the operation position, the line guide mechanism 100 is for guiding movement of a portion of a line of the tugboat 1 towards a predetermined region R of the perimeter P of the hull 11. In this embodiment, the line of the tugboat 1 to be guided by the line guide mechanism 100 is the messenger line 13, but in other embodiments a line of the tugboat other than the messenger line 13 may be guided by the line guide mechanism 100. Positioning the line of the tugboat 1 in or near the predetermined region R of the perimeter P in this way can aid subsequent coupling of the line of the tugboat 1 to a line of a marine vessel to be assisted by the tugboat 1, as will be described below in more detail.

In this embodiment, the predetermined region R of the perimeter P is at the bow end of the hull 11 on a central axis A-A that extends in a fore and aft direction of the tugboat 11. However, in other embodiments, the predetermined region R of the perimeter P may be, for example, at the stem of the tugboat 1 or on the port or starboard side of the tugboat 1. When the predetermined region R of the perimeter P is at a location other than that of this embodiment, the line handling system 10 may be relocated elsewhere relative to the hull 11, or otherwise modified to accommodate the difference in location of the predetermined region R of the perimeter P, accordingly. In some embodiments, the line handling system 10 may be movable, such as rotatable e.g. about an axis that passes through the hull 11, relative to the hull 11 so as to vary the predetermined region R of the perimeter P towards which the line guide mechanism 100 is able to guide the line of the tugboat 1. Such an axis may pass through the deck 12. The axis may be substantially parallel to a yaw axis of the tugboat 1. The line handling system 100 may be moveable in this way while the tugboat 1 moves relative to the marine vessel to be assisted by the tugboat 1. This movability of the line handling system may be useful for enabling the line handling system 10 to guide the line of the tugboat 1 towards a particular part of the perimeter P that will facilitate subsequent coupling of the line of the tugboat 1 to the line of the marine vessel. The part of the perimeter P may, for example, be the part of the perimeter P that is closest to the marine vessel.

In FIG. 1, the line guide mechanism 100 is shown at a stowed position. In this embodiment, at the stowed position, the line guide mechanism 100 is located within the perimeter P of the hull 11. More specifically, in this embodiment, at the stowed position, the line guide mechanism 100 is located on or adjacent the deck 12 and below a working surface of the edge of the hull 11. The line guide mechanism 100 may be parallel or substantially parallel to the deck 12 when at the stowed position. Accordingly, the line guide mechanism 100 is less likely to get in the way of crew members and operation of equipment on the tugboat 1. Moreover, the line guide mechanism 100 is unlikely to interrupt the movement of lines, such as the tow lines 15, along the working surface. However, in other embodiments, at the stowed position, the line guide mechanism 100 may be located elsewhere, such as on or above an upper edge of the hull 11, or outside of the perimeter P of the hull 11.

In this embodiment, the line guide mechanism 100 comprises first and second guide devices 110, 120 and an intermediate portion 130 between the first and second guide devices 110, 120. In this embodiment, the first guide device 110 is located on the port side and the second guide device 120 is located on the starboard side. However, in other embodiments the first and second guide devices 110, 120 may be arranged otherwise, such as both on the port or starboard side. In some embodiments, one or other of the first and second guide devices 110, 120 may be omitted, so that the line guide mechanism 100 comprises only one guide device 110, 120.

In this embodiment, the first guide device 110 comprises a first guide arm 111, and the second guide device 120 comprises a second guide arm 121. Moreover, in this embodiment, each of the first and second guide arms 111, 121 has a distal end 111*d*, 121*d* that is distal from the intermediate portion 130, an opposite proximate end that is adjacent the intermediate portion 130, and each of the first and second guide arms 111, 121 is curved so as to bow outwards away from the other of the first and second guide arms 111, 121 between the proximate and distal ends. However, in other embodiments, one or each of the first and second guide arms 111, 121 could be shaped differently. For example, in some embodiments, one or each of the first and second guide arms 111, 121 may follow another non-linear path, or may be straight or substantially straight.

In this embodiment, the line guide mechanism 100 is movable relative to the hull 11 between the stowed position of FIG. 1 and the operation position of FIG. 2. More specifically, in this embodiment, the line guide mechanism 100 is rotatable between the stowed and operation positions about an axis B-B that is substantially parallel to the deck 12. In this embodiment, the axis B-B about which the line guide mechanism 100 is rotatable between the stowed and operation positions is substantially parallel to a width of the tugboat 1. However, in other embodiments, such as some of those in which the line handling system 10 is located somewhere on the tugboat 1 other than at the bow end, the axis B-B about which the line guide mechanism 100 is rotatable between the stowed and operation positions may be other than in this embodiment. For example, the axis B-B may be non-parallel to the tugboat 1 width, such as perpendicular or oblique to the tugboat 1 width and/or may be non-parallel to the deck 12, such as perpendicular or oblique to the deck 12. Still further, in some embodiments movement of the line guide mechanism 100 relative to the hull 11 between the stowed and operation positions may be other than a rotation, such as a translation or a combination of rotation and translation.

In this embodiment, and as indicated in FIG. 1, the line guide mechanism 100 comprises a driver 140 for driving movement of the line guide mechanism 100 to and from the operation position relative to the hull 11, and a user operable controller 19 for controlling the driver 140. The driver 140 may take any suitable form, such as one or more electric or other motors, optionally with a drivetrain or gearbox between the motor(s) and the line guide mechanism 100. In some embodiments, the driver 140 may comprise a hydraulic cylinder or other actuator. The user operable controller 19 is in the wheelhouse 18, but in other embodiments the user operable controller 19 may be elsewhere, such as on the deck 12. The user operable controller 19 may comprise one or more input devices for a user to input commands to the controller 19, such as button(s), dial(s), joystick(s) or a touchscreen. In some embodiments, the line guide mechanism 100 may be manually moveable to and from the operation position, such as between the stowed and operation positions.

When the line guide mechanism 100 is at the operation position of FIG. 2, the first and second guide arms 111, 121 protrude upwards away from the hull and are configured so that, in use, a part of a line of the tugboat 1 overlying either one of the guide arms 111, 121 is encouraged to move along the guide arm 111, 121 that the line overlies and away from the distal end 111*d*, 121*d* of the guide arm 111, 121 towards the predetermined region R of the perimeter P. This encouragement of movement may be due to the action of a gravitational force on the line and/or due to a portion of the line lying in the water in which the tugboat 1 sits and being pulled by the water so as to create a force that draws the line downward.

In this embodiment, the configuration of the first and second guide arms 111, 121 that encourages this movement comprises the geometry and surface properties of the first and second guide arms 111, 121, and the positioning of the first and second guide arms 111, 121 relative to the hull 11. More specifically, the first and second guide arms 111, 121 are shaped so as to avoid or reduce hinderance to movement of lines along them. Moreover, each of the first and second guide arms 111, 121 is smooth, to facilitate sliding, rolling or other movement of lines along them. Indeed, it is preferable for all surfaces along which the lines may move to be smoothly curved and free from sharp or pointed features, so as to avoid the lines catching. Furthermore, the first and second guide arms 111, 121 are aligned relative to the hull 11 so that movement of a part of a line along either of the first and second guide arms 111, 121 is movement towards the predetermined region R of the perimeter P. In other embodiments, the first and second guide arms 111, 121 may have any or all of these characteristics, and/or may have other characteristics that help to encourage this line movement towards the predetermined region R of the perimeter P.

As mentioned above, in this embodiment the second end of the messenger line 13 is shown in FIG. 1 as hanging or draping over the perimeter P of the hull 11. The alignment of the messenger line 13 is such that part of the messenger line 13 overlies the second guide arm 121 when the line guide mechanism 100 is at the stowed position. Accordingly, as the line guide mechanism 100 moves relative to the hull 11 between the stowed position of FIG. 1 and the operation position of FIG. 2, the part of the messenger line 13 overlying the second guide arm 121 is lifted away from the hull 11. As the second guide arm 121 becomes increasingly normal or perpendicular to the deck as the operation position is approached, the part of the messenger line 13 experiences an increasing force in the direction generally towards the hull 11 and the water in which the tugboat 1 sits. When the line guide mechanism 100 reaches the operation position of FIG. 2, the part of the messenger line 13 slides, rolls or otherwise moves along the second guide arm 121 towards the predetermined region R of the perimeter P, if it has not already done so during the movement of the line guide mechanism 100, as indicated by the arrow in FIG. 2. The messenger line 13 thus falls or otherwise moves into the predetermined region R of the perimeter P.

It will be noted that, in this embodiment, respective secondary guides 112, 122 of the first and second guide devices 110, 120, which will be described in more detail below, overlay the first and second guide arms 111, 121 when the line guide mechanism 100 is at the stowed position. This is to help make the line guide mechanism 100 relatively compact when in the stowed position, and to avoid the secondary guides 112, 122 otherwise contacting or interfering with the rim of the hull 11 during movement of the line guide mechanism 100 between the stowed and operation positions. The secondary guides 112, 122 are moved relative to the first and second guide arms 111, 121 of the respective guide devices 110, 120 before or after the line guide mechanism 100 has reached the operation position, so as to reduce the chance of movement of the line (in this embodiment, the messenger line 13) along one or other of the first and second guide arms 111, 121 being blocked by the secondary guides 112, 122.

In this embodiment, each of the first and second guide arms 111, 121 is rotatable relative to the hull 11 about a respective pivot point 111*p*, 121*p*. In this embodiment, such rotation moves the respective distal ends 111*d*, 121*d* of the guide arms 111, 121 distal to the pivot points 111*p*, 121*p* towards and away from the central axis A-A that extends in a fore and aft direction of the tugboat 1. In embodiments in which the line guide mechanism 100 is located elsewhere on the tugboat 1, the rotation of the guide arms 111, 121 relative to the hull 11 may move the distal ends 111*d*, 121*d* towards and away from an axis that extends in a different direction of the tugboat 1. In some embodiments, each of the first and second guide arms 111, 121 may instead be movable relative to the hull 11 in a different manner, such as by translation or a combination of rotation and translation.

In this embodiment, the first and second guide arms 111, 121 are movable towards and away from each other. More specifically, the first and second guide arms 111, 121 are rotatable relative to the hull 11 about the respective pivot points 111*p*, 121*p*, so as to move the distal ends 111*d*, 121*d* of the guide arms 111, 121 towards and away from each other. The ability of the first and second guide arms 111, 121 to move in this way can provide several benefits, such as helping to make the line guide mechanism 100 relatively compact when in the stowed position, permitting the angle of inclination of the guide arms 111, 121 to be adjusted to control the rate at which the line of the tugboat 1 moves along one or other of the guide arms 111, 121 when the line guide mechanism 100 is at the operation position, and aiding the capture of a line of the marine vessel to be assisted when the line guide mechanism 100 is at a deployed position, as will be discussed below.

In this embodiment, when the line guide mechanism 100 is at the operation position, the first and second guide arms 111, 121 and the intermediate portion 130 of the line guide mechanism 100 together substantially define a U-shape. However, in some embodiments in which the intermediate portion 130 is relatively small, the first and second guide arms 111, 121 and the intermediate portion 130 may together substantially define a V-shape. Similarly, in embodiments in which the intermediate portion 130 is omitted, the first and second guide arms 111, 121 may together substantially define a V-shape.

In this embodiment, the line handling system 100 comprises a line engager 230 for engaging with the line of the tugboat 1 when the line of the tugboat 1 is at the predetermined region R of the perimeter P of the hull 11. In this embodiment, the line engager 230 defines a coupling zone 250 into which a portion of the line of the tugboat 1 is insertable. The line engager 230 in this embodiment is part of an actuatable coupling mechanism 200, which will be described in more detail below. However, in other embodiments, the line engager 230 may take a different form to that of this embodiment.

Figure 3:
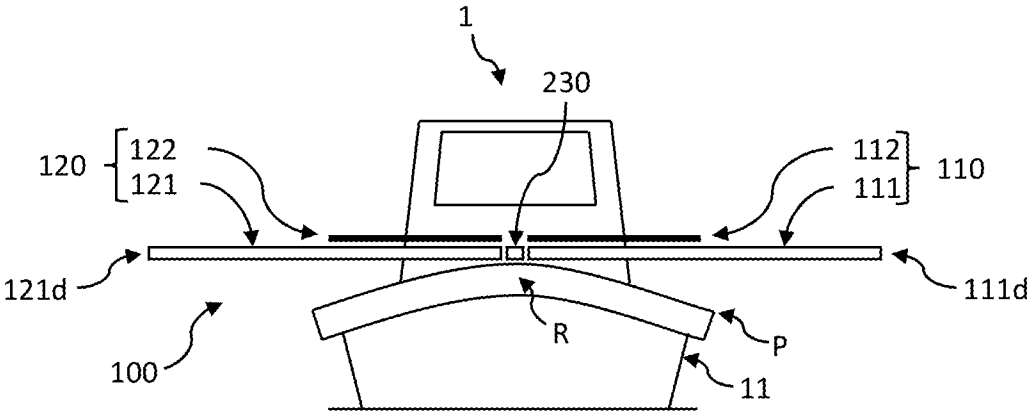
FIG. 3 shows a schematic front view of the tugboat of FIG. 2, wherein the line guide mechanism has been moved to a deployed position, at which the line guide mechanism protrudes away from the hull over the water in which the tugboat is sitting for guiding a line of a marine vessel towards the predetermined region of the perimeter of the hull.
Figure 4:
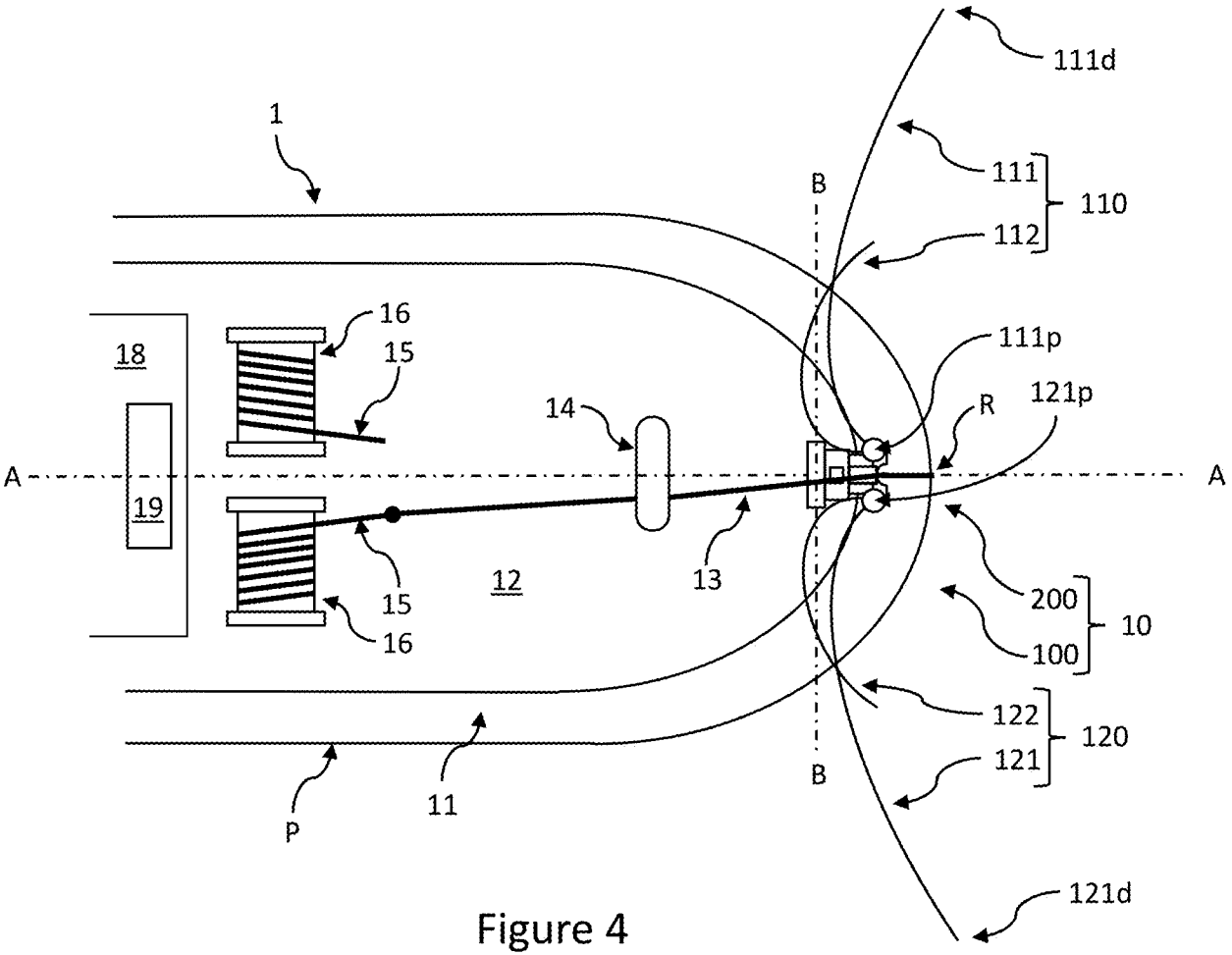
FIG. 4 shows a partial schematic top view of the tugboat of FIG. 3, in which it can be seen that the line of the tugboat has been guided to the predetermined region of the perimeter of the hull by the line guide mechanism.

The line guide mechanism 100 of this embodiment is movable relative to the hull 11 between the operation position and a deployed position. FIGS. 3 and 4 respectively show a schematic front view and a partial schematic top view of the tugboat 1 of FIGS. 1 and 2, but when the line guide mechanism 100 is at the deployed position. In this embodiment, the operation position is between the stowed position and the deployed position of the line guide mechanism 100, but in other embodiments the positions may be in a different order. When the line guide mechanism 100 is at the deployed position, the line guide mechanism 100 protrudes away from the hull 11 for guiding a line of a marine vessel towards the predetermined region R of the perimeter P of the hull 11. The marine vessel could be a vessel the tugboat 1 is to assist manoeuvre. More specifically, when the line guide mechanism 100 is at the deployed position, the line guide mechanism 100 protrudes away from the perimeter P of the hull 11 and over the water in which the tugboat 1 sits. Positioning the line of the marine vessel in or near the predetermined region R of the perimeter P in this way can aid subsequent coupling of the line of the tugboat 1 to the line of the marine vessel, as will be described below in more detail.

Since the line guide mechanism 100 is for guiding the line of the marine vessel towards the predetermined region R of the perimeter P, it is possible for the line (such as a heaving line) of the marine vessel to be thrown towards the line guide mechanism 100, rather than towards the deck 12 of the tugboat 1 or an AB or other crew member standing on the deck 12. Accordingly, crew members on the tugboat 1 are less likely to be injured, and the tugboat 1 itself it less likely to be damaged, by lines thrown from the marine vessel.

In some embodiments, the line handling system 10 may be movable, such as rotatable e.g. about an axis that passes through the hull 11, relative to the hull 11 so as to vary the predetermined region R of the perimeter P towards which the line guide mechanism 100 is able to guide the line of the marine vessel. Such an axis may pass through the deck 12. The axis may be substantially parallel to a yaw axis of the tugboat 1. This movability of the line handling system may facilitate successful throwing of the line of the marine vessel to the tugboat 1, since the visible "target" defined by the line guide mechanism 100, and more specifically by the guide arms 111, 121, may be positioned to face the marine vessel. The line handling system 100 may be moveable in this way while the tugboat 1 and the marine vessel move relative to each other, so that the "target" remains the same from the perspective of the marine vessel irrespective of the position of the tugboat 1 relative to the marine vessel.

The line guide mechanism 100 of this embodiment is movable relative to the hull 11 between the deployed and stowed positions shown in FIGS. 4 and 1, respectively. The line guide mechanism 100 does not protrude away from the hull 11 when at the stowed position in this embodiment, as described above. However, in other embodiments, the line guide mechanism 100 may protrude away from the hull 11 when at the stowed position, but optionally to a lesser extent than when the line guide mechanism 100 is at the deployed position.

In this embodiment, the line guide mechanism 100 is rotatable between the operation and deployed positions about the axis B-B that is substantially parallel to the deck 12 and the width of the tugboat 1. However, as noted above, in other embodiments, the axis B-B may be non-parallel to the tugboat 1 width and/or the deck 12. In some embodiments, the rotation between the operation and deployed positions may be about an axis other than the axis B-B. Moreover, in some embodiments, movement of the line guide mechanism 100 relative to the hull 11 between the operation and deployed positions may be other than a rotation, such as a translation or a combination of rotation and translation. In this embodiment, the driver 140 is for driving movement of the line guide mechanism 100 to and from the deployed position relative to the hull 11 under the control of the user operable controller 19, but in other embodiments the line guide mechanism 100 may be caused to move in some other way. In some embodiments, the line guide mechanism 100 may be manually moveable to and from the deployed position, such as between the operation and deployed positions.

As discussed above, the line guide mechanism 100 of this embodiment comprises first and second guide devices 110, 120, each of which comprises a respective one of the guide arms 111, 121. The guide arms 111, 121 protrude away from the hull 11 when the line guide mechanism 100 is at the deployed position. Furthermore, as also discussed above, each of the first and second guide arms 111, 121 of this embodiment is rotatable relative to the hull 11 about the respective pivot points 111*p*, 121*p*, so as to move the respective distal ends 111*d*, 121*d* of the guide arms 111, 121 towards and away from each other. In this embodiment, when the line guide mechanism 100 is at the deployed position, the pivot points 111*p*, 121*p* are located inwardly of the perimeter P of the hull 11. In other embodiments, the pivot points 111*p*, 121*p* may be located on or outwardly of the perimeter P of the hull 11. The line (such as a heaving line) of the marine vessel is intended to be received between the first and second guide arms 111, 121. Moving the distal ends 111*d*, 121*d* away from each other increases the width of an area the guide arms 111, 121 are able to sweep during movement of the tugboat 1. In turn, this increases the area into which the line of the marine vessel may be thrown, while still subsequently being guidable by the line guide mechanism 100 towards the predetermined region R of the perimeter P of the hull 11.

In this embodiment, the first and second guide arms 111, 121 are movable independently of each other relative to the hull 11. However, in other embodiments, the first and second guide arms 111, 121 may be movable dependently of each other relative to the hull 11. In this embodiment, and as indicated in FIG. 1, the line guide mechanism 100 comprises a drive mechanism 142 for driving movement of the first and second guide arms 111, 121 relative to the hull 11, and a user operable controller for controlling the drive mechanism 142. The drive mechanism 142 may take any suitable form, such as one or more electric or other motors, optionally with a drivetrain or gearbox between the motor(s) and the first and second guide arms 111, 121. In some embodiments, the drive mechanism 142 may comprise a hydraulic cylinder or other actuator. In this embodiment, the user operable controller 19 is that discussed above and located in the wheelhouse 18. However, in other embodiments, the user operable controller for controlling the drive mechanism 142 may be separate from the user operable controller 19 discussed above and/or may be located elsewhere, such as on the deck 12. The user operable controller for controlling the drive mechanism 142 may comprise one or more input devices for a user to input commands to the controller 19, such as button(s), dial(s), joystick(s) or a touchscreen. In some embodiments, the first and second guide arms 111, 121 may be manually moveable relative to the hull 11.

In some further embodiments, the first and second guide arms 111, 121 may be immovable or substantially immovable relative to the hull 11 when the line guide mechanism 100 is at the deployed position. In such embodiments, the line of the marine vessel can be urged to move towards the line engager 230 by moving the tugboat 1 relative to the line of the marine vessel.

In FIGS. 3 and 4, and as compared to the arrangement shown in FIG. 2, it can be seen that the first and second guide arms 111, 121 have been moved relative to the hull 11 so that the distal ends 111*d*, 121*d* of the guide arms 111, 121 are splayed further apart. Indeed, in this embodiment, the distal ends 111*d*, 121*d* are spaced apart by a distance greater than the beam (i.e. the maximum width) of the tugboat 1. In other embodiments, the distal ends 111*d*, 121*d* may be spaced apart by a distance less than or equal to the beam of the tugboat 1.

Figure 5:
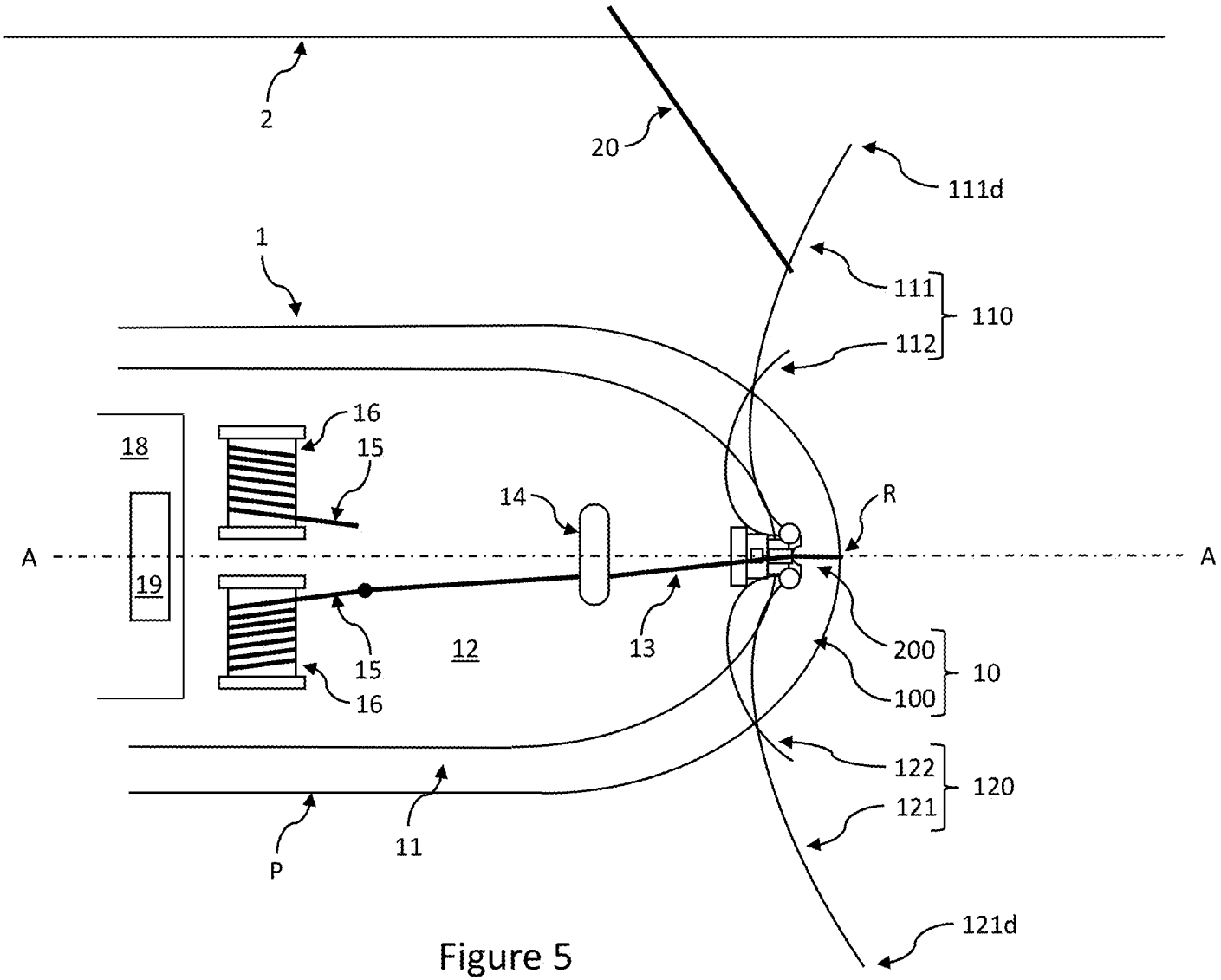
FIG. 5 shows a partial schematic top view of the tugboat of FIGS. 3 and 4, wherein the tugboat is now adjacent a marine vessel to be assisted and a line of the marine vessel is draped over one of two guide arms of the line guide mechanism.

In FIG. 5, the tugboat 1 of FIGS. 3 and 4 is now adjacent a marine vessel 2 to be maneuvered by the tugboat 1. The marine vessel may, for example, be a container ship. Moreover, a portion of a line 20 of the marine vessel 2, which in this embodiment is a heaving line 20, has been thrown from a position on the marine vessel 2 astern of the first guide arm 111 of the line guide mechanism 100, and is draped over the first guide arm 111 of the line guide mechanism 100. The heaving line 20 may, for example, have a diameter of 12 millimetres. Once the heaving line 20 of the marine vessel 2 is draped over the first guide arm 111 of the line guide mechanism 100 in this way, the heaving line 20 is thereafter able to be guided towards the predetermined region R of the perimeter P of the hull 11 by the line guide mechanism 100.

Figure 6:
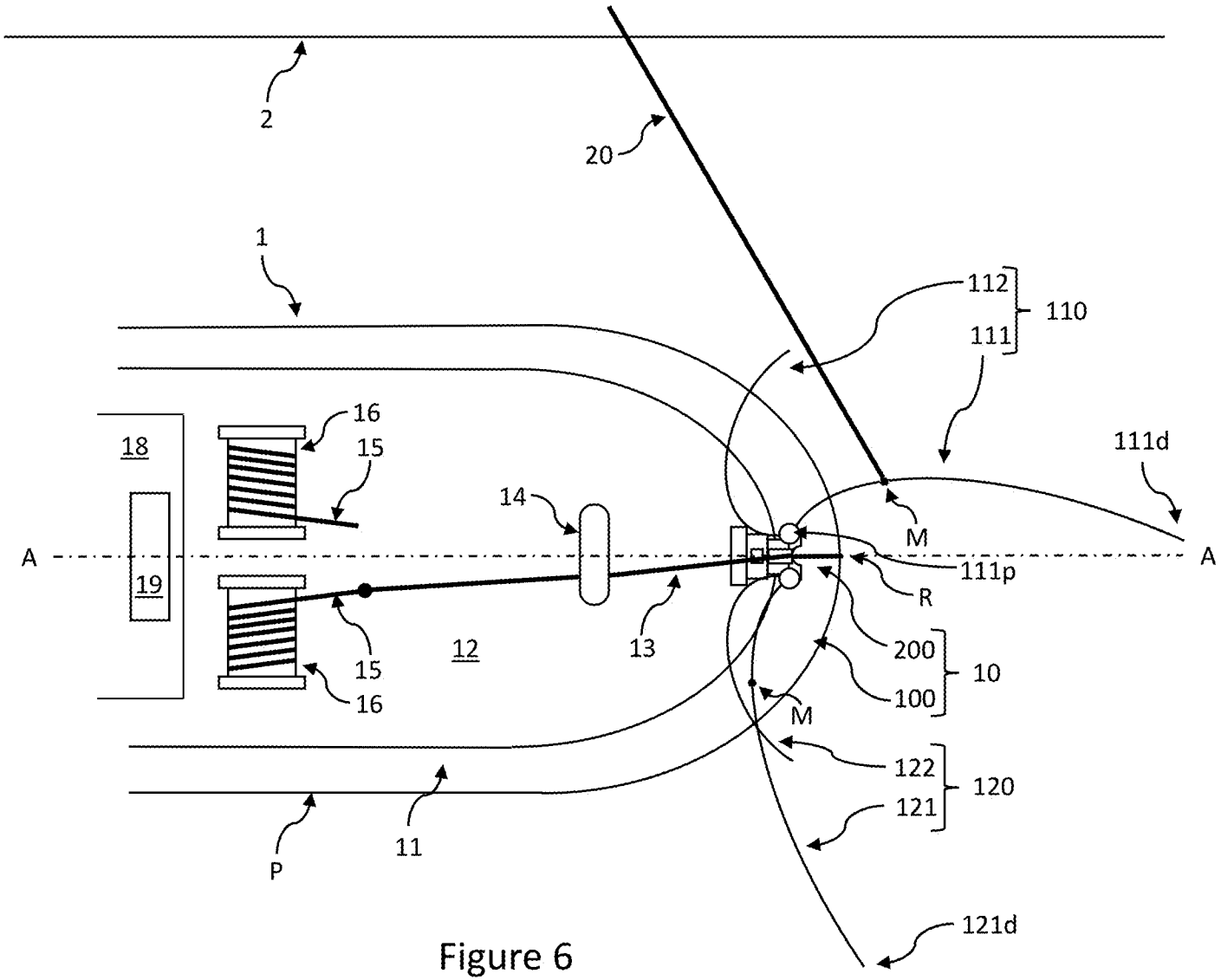
FIG. 6 shows a partial schematic top view of the tugboat of FIG. 5, wherein the guide arm over which the line of the marine vessel is draped has been rotated relative to the hull so that a distal end of the guide arm is closer to an axis that extends in a fore and aft direction of the tugboat.

More specifically, and with reference to FIG. 6, the first guide arm 111 over which the heaving line 20 of the marine vessel 2 is draped has been rotated relative to the hull 11, so that the distal end 111*d* of the first guide arm 111 moves closer to the central axis A-A that extends in the fore and aft direction of the tugboat 1. This has the effect of drawing the heaving line 20 closer to the predetermined region R of the perimeter P of the hull 11.

The heaving line 20 is then guided still closer to the predetermined region R of the perimeter P of the hull 11 by the secondary guides 112, 122 of the line guide mechanism 100, which were briefly discussed above. Each of the guide devices 110, 120 of the line guide mechanism 100 comprises a respective one of the secondary guides 112, 122. The first secondary guide 112 is movable relative to the first guide arm 111 for driving a line along the first guide arm 111 towards the predetermined region R of the perimeter P. Similarly, the second secondary guide 122 is movable relative to the second guide arm 121 for driving a line along the second guide arm 121 towards the predetermined region R of the perimeter P. Still further, in this embodiment the movement of the secondary guides 112, 122 of the first and second guide devices 110, 120 relative to the hull 11 comprises movement of the secondary guides 112, 122 towards each other.

In this embodiment, the secondary guides 112, 122 are rotatable relative to the guide arms 111, 121, but in other embodiments the movement of the secondary guides 112, 122 relative to the guide arms 111, 121 may be other than rotations, such as translations or a combination of rotations and translations. In this embodiment, the rotations of the secondary guides 112, 122 are about the same respective axes as the rotations of the guide arms 111, 121 relative to the hull 11. That is, the secondary guides 112, 122 are rotatable about the same pivot points 111*p*, 121*p* as the first and second guide arms 111, 121. However, in other embodiments, the secondary guides 112, 122 may be rotatable about pivot points other than the pivot points 111*p*, 121*p* of the first and second guide arms 111, 121.

In some embodiments, the first and second secondary guides 112, 122 are movable independently of each other relative to the hull 11 and the respective guide arms 111, 121. However, in other embodiments, the first and second secondary guides 112, 122 may be movable dependently of each other relative to the hull 11 and the respective guide arms 111, 121. In this embodiment, and as indicated in FIG. 1, the line guide mechanism 100 comprises a drive device 144 for driving movement of the first and second secondary guides 112, 122 relative to the hull 11 and the respective guide arms 111, 121, and a user operable controller for controlling the drive device 144. The drive device 144 may take any suitable form, such as one or more electric or other motors, optionally with a drivetrain or gearbox between the motor(s) and the first and second secondary guides 112, 122. In some embodiments, the drive device 144 may comprise a hydraulic cylinder or other actuator. In this embodiment, the user operable controller 19 is that discussed above and located in the wheelhouse 18. However, in other embodiments, the user operable controller for controlling the drive device 144 may be separate from the user operable controller 19 discussed above and/or may be located elsewhere, such as on the deck 12. The user operable controller for controlling the drive device 144 may comprise one or more input devices for a user to input commands to the controller, such as button(s), dial(s), joystick(s) or a touchscreen. In some embodiments, the first and second secondary guides 112, 122 may be manually moveable relative to the hull 11 and the respective guide arms 111, 121.

In this embodiment, the first guide arm 111 comprises an indicator or marker M that is located part way along the first guide arm 111. The indicator or marker M indicates a position or region on the first guide arm 111. More specifically, the indicator or marker M indicates a position or region on the first guide arm 111 at which the line 20 of the marine vessel 2 should be located before the first secondary guide 112 is moved to drive the line 20 along the first guide arm 111 towards the predetermined region R of the perimeter P. The region may be that between the indicator or marker M and the pivot point 111*p* of the first guide arm 111. A crew member is able to visually monitor the position or progress of the line 20 relative to the indicator or marker M. When they note that the line 20 is at the position or region on the first guide arm 111 indicated by the indicator or marker M, they cause movement of the first secondary guide 112 to drive the line 20 along the first guide arm 111 towards the predetermined region R of the perimeter P. This causation may be due to the crew member's operation of the user operable controller for controlling the drive device 144, or due to the crew member's manual movement of the first secondary guide 112. Accordingly, the indicator or marker M helps to ensure that the line 20 is correctly positioned on the first guide arm 111 for successful subsequent driving of the line 20 along the first guide arm 111 by the first secondary guide 112.

In this embodiment, the indicator or marker M is located closer to the pivot point 111*p* of the first guide arm 111 than to the distal end 111*d* of the first guide arm 111. However, in other embodiments, depending on the geometry of the line guide mechanism 100, the indicator or marker M may be located midway between the pivot point 111*p* and the distal end 111*d* of the first guide arm 111, or may be located closer to the distal end 111*d* of the first guide arm 111 than to the pivot point 111*p* of the first guide arm 111.

The indicator or marker M may take any suitable form. For example, the indicator or marker M may be a marking applied (such as by painting) at a point on the first guide arm 111, or may be a point on the first guide arm 111 at which two portions of the first guide arm 111 with different appearances (such as colours) meet. The indicator or marker M preferably does not interfere with movement of the line 20 along the first guide arm 111.

In this embodiment, the second guide arm 121 also comprises such an indicator or marker M that is located part way along the second guide arm 121 for indicating a position or region of the second guide arm 121 at which a line of a marine vessel should be located before the second secondary guide 122 is moved to drive the line along the second guide arm 121 towards the predetermined region R of the perimeter P. In other embodiments, only one (or none) of the first and second guide arms 111, 121 may comprise such an indicator or marker M.

Figure 7:
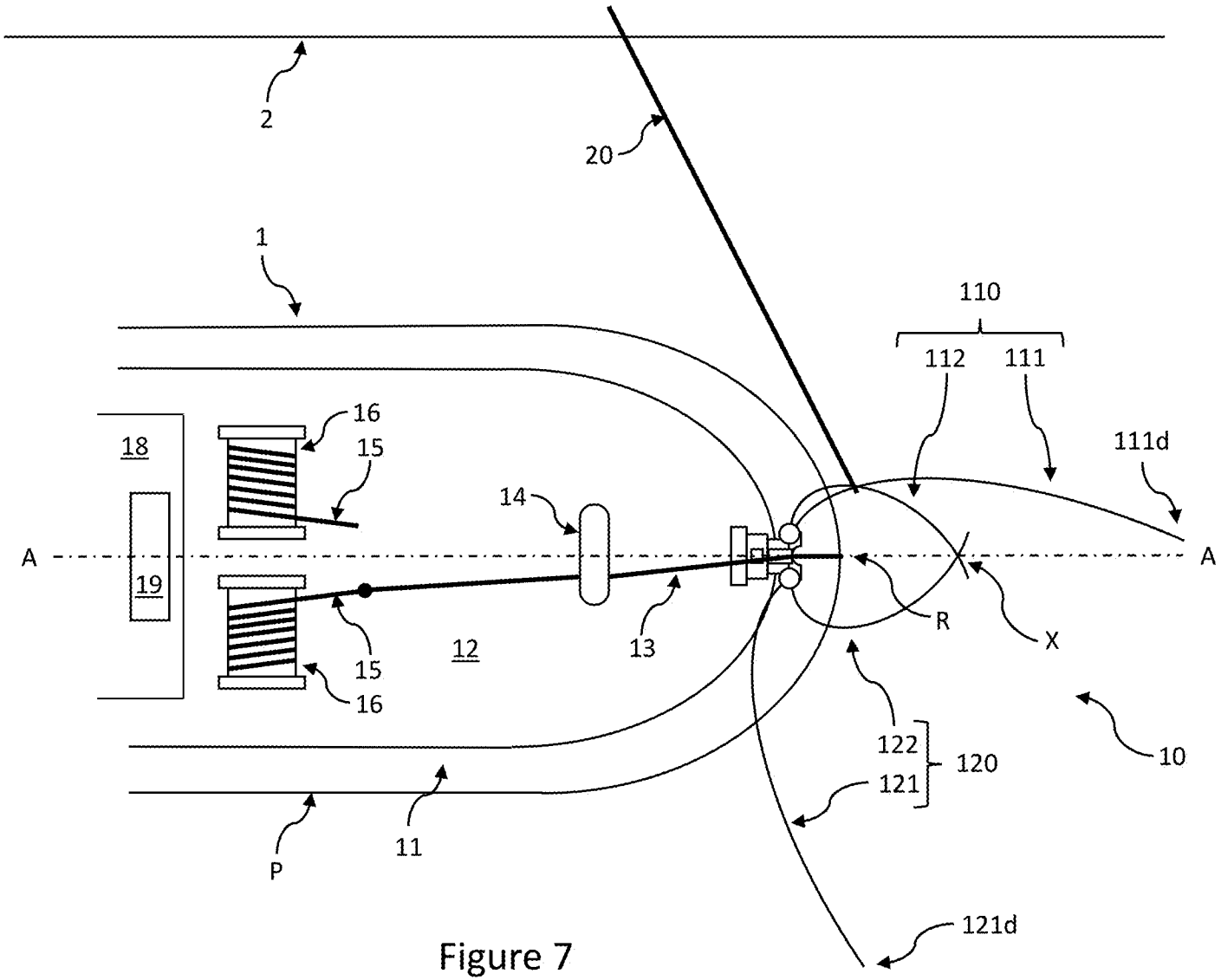
FIG. 7 shows a partial schematic top view of the tugboat of FIG. 6, wherein secondary guides of the line guide mechanism have been rotated relative to the guide arm to drive the line of the marine vessel along the guide arm towards the predetermined region of the perimeter of the hull.

With reference to FIG. 7, both of the secondary guides 112, 122 have been rotated relative to the hull 11 and the first guide arm 111, as compared to the situation shown in FIG. 6. This has the effect in this embodiment of bringing the first secondary guide 112 into contact with the heaving line 20 of the marine vessel 2, and then driving the heaving line 20 along the first guide arm 111 and closer towards the predetermined region R of the perimeter P of the hull 11.

Figure 8:
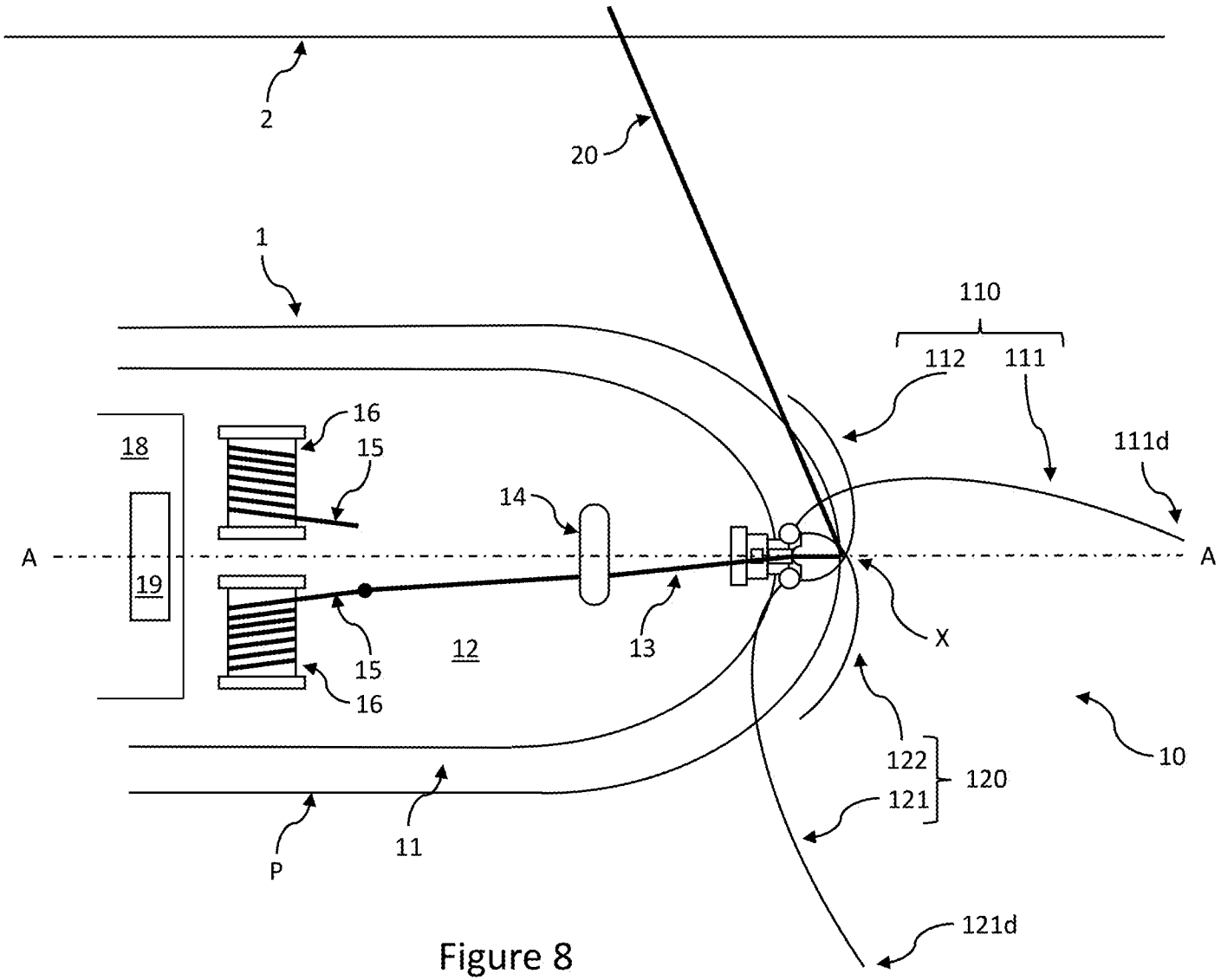
FIG. 8 shows a partial schematic top view of the tugboat of FIG. 7, wherein the secondary guides have been further rotated relative to the guide arm to lift the line of the marine vessel from the guide arm and carry the line further towards the predetermined region of the perimeter.
Figure 9:
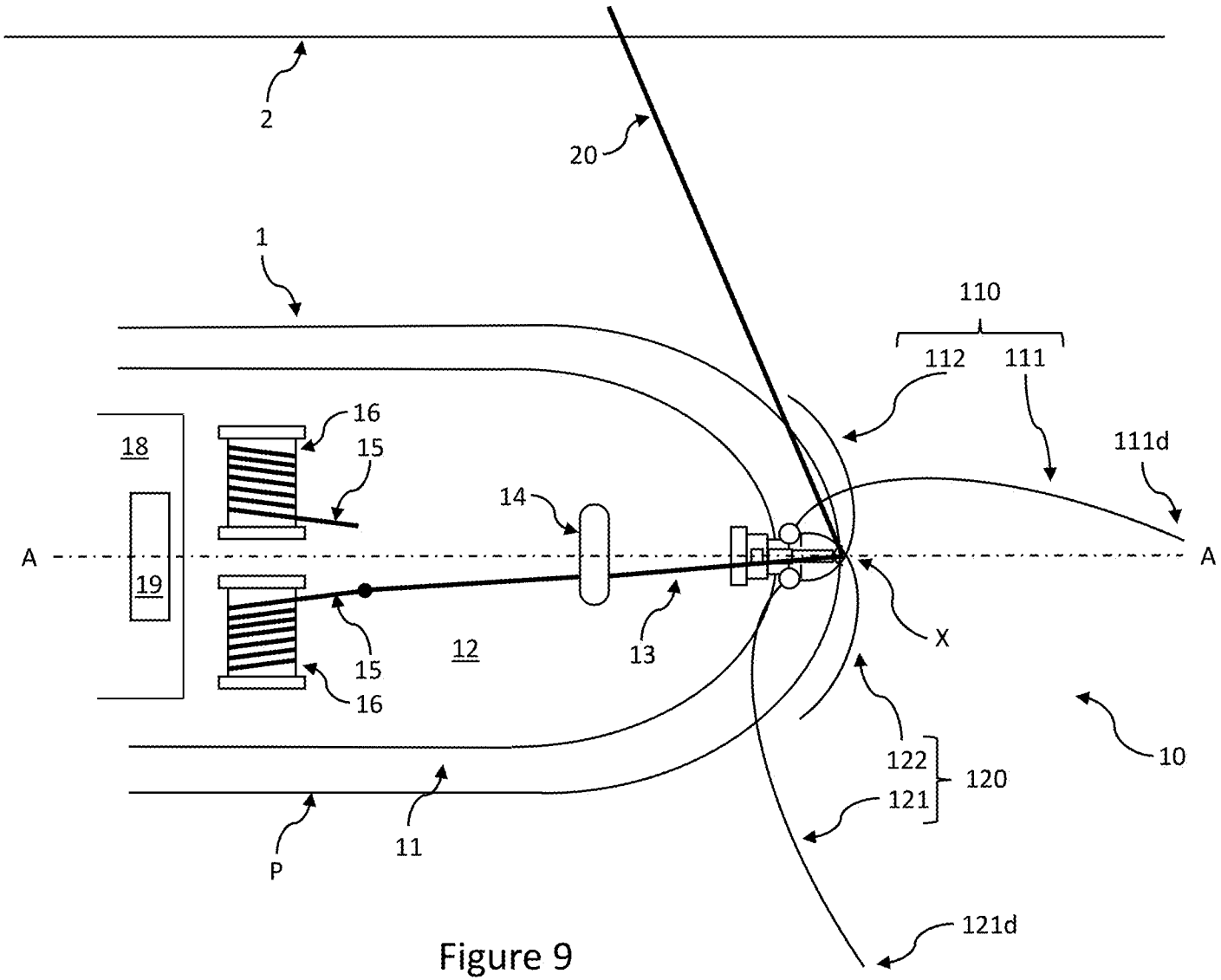
FIG. 9 shows a partial schematic top view of the tugboat of FIG. 8, wherein a line engager of an actuatable coupling mechanism of the line handling system has moved to aid alignment of a coupling zone of the actuatable coupling mechanism with the lines.
Figure 13:
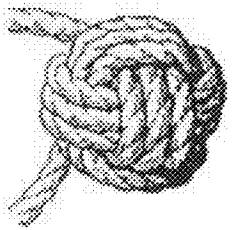
FIG. 13 shows a schematic perspective view of a monkey's fist knot.

With reference to FIG. 8, both of the secondary guides 112, 122 have been further rotated relative to the hull 11 and the first guide arm 111, as compared to the situation shown in FIG. 7. This has the effect in this embodiment of lifting the heaving line 20 of the marine vessel 2 from the first guide arm 111 and carrying the heaving line 20 further towards the predetermined region R of the perimeter P of the hull 11.

It will be noted from FIGS. 7 and 8 that, during movement of the respective secondary guides 112, 122 relative to the hull 11, the secondary guides 112, 122 cross over each other at a cross over point X that moves along both of the secondary guides 112, 122. In other embodiments, the geometry and operation of the secondary guides 112, 122 may be such that the cross over point X moves along only one of the secondary guides 112, 122. This crossing over means that the secondary guides 112, 122 and the hull 11 together surround the space within which the heaving line 20 and the messenger line 13 are located. This helps to retain the heaving line 20 and the messenger line 13 relative to the line guide mechanism 100. Furthermore, in this embodiment, each of the secondary guides 112, 122 has a parabolic shape. This helps to avoid the cross over point X forming a sharp angle and reduces the risk of the secondary guides 112, 122 trapping or pinching the heaving line 20 at the cross over point X. In some embodiments, the geometry of the secondary guides 112, 122 may be such that the secondary guides 112, 122 never cross over each other. In still further embodiments, one or both of the secondary guides 112, 122 may be omitted.

In the situation in FIG. 8, both the messenger line 13 of the tugboat 1 and the heaving line 20 of the marine vessel 2 are now located in the predetermined region R of the perimeter P of the hull 11. Furthermore, the two lines 13, 20 are in the space surrounded by the secondary guides 112, 122 and the hull 11. The two lines 13, 20 are now to be coupled by the actuatable coupling mechanism 200 of the line handling system 10, which was briefly mentioned above but will now be described in more detail with reference to FIGS. 9 to 12.

In this embodiment, the actuatable coupling mechanism 200 is for coupling together a line of the tugboat 1 and a line of the marine vessel 2 by applying a connector to the lines when actuated. More specifically, in this embodiment, the actuatable coupling mechanism 200 is for coupling the messenger line 13 of the tugboat 1 to the heaving line 20 of the marine vessel 2 when the messenger line 13 of the tugboat 1 and the heaving line 20 of the marine vessel 2 are at the predetermined region R of the perimeter P.

As mentioned above, in some embodiments the line handling system 10 is movable (e.g. rotatable) relative to the hull 11. Such movement is usable to vary the predetermined region R of the perimeter P at which the actuatable coupling mechanism 200 is suitable for coupling together the lines 13, 20.

As briefly mentioned above, the actuatable coupling mechanism 200 comprises the line engager 230, which defines a coupling zone 250. In this embodiment, the line engager 230 comprises a fork having two prongs 231, 232, and the coupling zone 250 is defined by and between the prongs 231, 232. In other embodiments, the line engager 230 may take a different form. The line engager 230 is for engaging with the heaving line 20 of the marine vessel 2 when the heaving line 20 of the marine vessel 2 is at the predetermined region R of the perimeter P. The coupling zone 250 is for receiving the lines 13, 20 to be coupled. The actuatable coupling mechanism 200 of this embodiment is actuatable to apply the connector to the lines 13, 20 when the lines 13, 20 are in the coupling zone 250. In other embodiments, the actuatable coupling mechanism 200 may not include a line engager 230 that defines a coupling zone 250, as such. For example, the actuatable coupling mechanism 200 may have sufficient freedom of movement that it is usable to couple lines 13, 20 at one of many locations on or around the tugboat 1.

In this embodiment, the actuatable coupling mechanism 200 comprises a support 240 for supporting the line engager 230, and the line engager 230 is movable relative to the support 240 for aiding alignment of the coupling zone 250 with the lines 13, 20. It can be seen in FIG. 10 that, in this embodiment, the line engager 230 has extended out from the support 240, as compared to the arrangement shown in FIG. 9. Although the messenger line 13 and the heaving line 20 have been omitted from FIG. 10 for clarity, it will be understood from FIG. 10 that such movement of the line engager 230 relative to the support 240 helps to ensure that the lines 13, 20 are received in the coupling zone 250 since the coupling zone 250 approaches the predetermined region R of the perimeter P. In some embodiments, the line engager 230 may be immovable relative to a support for supporting the line engager 230. For example, the lines 13, 20 may engage with the line engager 230 due to the guiding of the lines 13, 20 by the secondary guides 112, 122 and/or the guide arms 111, 121.

The actuatable coupling mechanism 200 of this embodiment has a sensor 260 for detecting a presence of the lines 13, 20 in the coupling zone 250, and for outputting a signal in dependence on the presence of the lines 13, 20 in the coupling zone 250. The sensor 260 may be a touch sensor and/or a proximity sensor, for example. Moreover, the actuatable coupling mechanism 200 is actuatable to apply the connector to the lines 13, 20 on the basis of the signal. In some embodiments, the actuatable coupling mechanism 200 may comprise a controller for receiving the signal and for causing actuation of the actuatable coupling mechanism 200 on the basis of the signal. For example, the actuatable coupling mechanism 200 may be configured to automatically actuate to apply the connector to the lines 13, 20 to couple together the lines 13, 20, when the signal indicates the presence of the lines 13, 20 in the coupling zone 250. Alternatively or additionally, the actuatable coupling mechanism 200 may be selectively actuatable by a user to apply the connector to the lines 13, 20 to couple together the lines 13, 20. For example, actuation of the actuatable coupling mechanism 200 may be controllable by a user from the user operable controller 19, in some embodiments. In some embodiments, the actuatable coupling mechanism 200 may have a controller that permits such selective actuation of the actuatable coupling mechanism 200 by a user on the basis of the signal from the sensor 260, such as only when the signal indicates the presence of the lines 13, 20 in the coupling zone 250.

The connector to be used for coupling together the messenger line 13 and the heaving line 20 may take one of many forms, such as for example a clip, a clamp, a pin or a strap. In this embodiment, the connector 210 is a length of wire. Moreover, in this embodiment, the actuatable coupling mechanism 200 comprises a supply 220 of wire, and is configured to cut the connector 210 from the supply 220. The wire may, for example, have a diameter of between 1 and 3 millimetres, such as between 1.5 and 2 millimetres, e.g. 1.8 millimetres. The supply 220 may hold, for example, 1 metre, 10 metres, or 100 metres of wire from which successive connectors 210 can be cut.

In this embodiment, the actuatable coupling mechanism 200 is configured to wrap the connector 210 around the lines 13, 20 when the actuatable coupling mechanism 200 is actuated. In this embodiment, the wrapping of the connector 210 around the lines 13, 20 involves causing the connector 210 to encircle the bundle of the lines 13, 20 only once, but in other embodiments the connector 210 may encircle the bundle of the lines 13, 20 more than once. The actuatable coupling mechanism 200 of this embodiment is also configured to twist together free ends 211, 212 of the connector 210 after wrapping the connector 210 around the lines 13, 20. This helps to hold the connector 210 in position relative to the lines 13, 20, and by consequence helps to hold the lines 13, 20 in position relative to each other.

Figure 11:
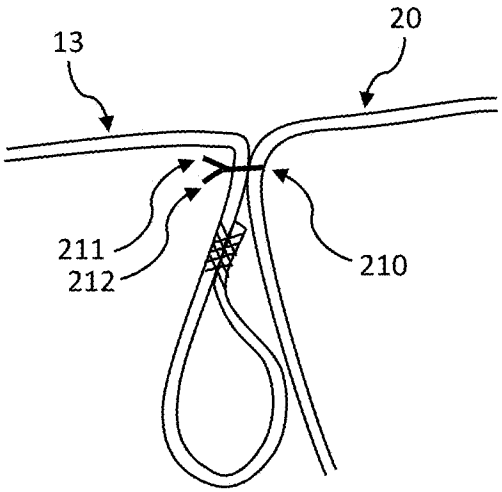
FIG. 11 is a partial schematic side view of the lines as coupled using a connector by the actuatable coupling mechanism.
Figure 10:
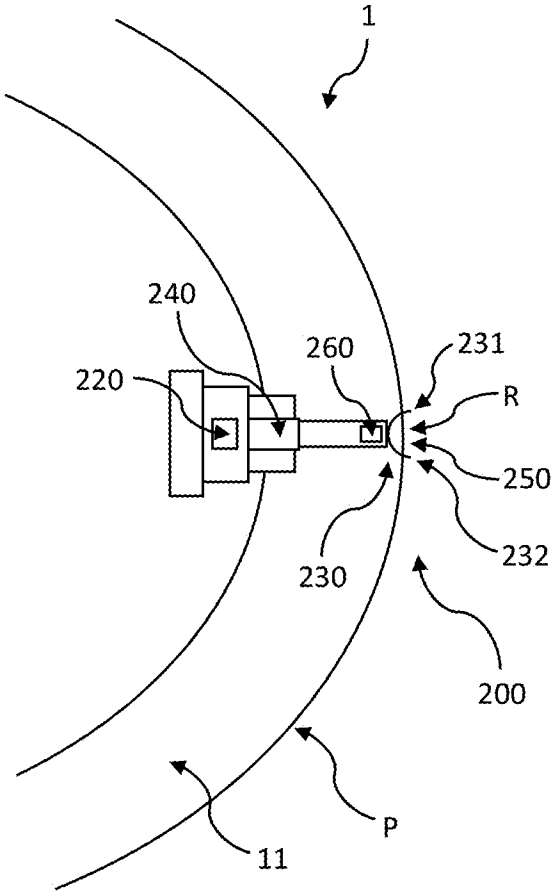
FIG. 10 shows a close-up schematic top view of the tugboat of FIG. 9, which focuses on the actuatable coupling mechanism and from which several other components of the line handling system have been omitted for clarity.
Figure 12:
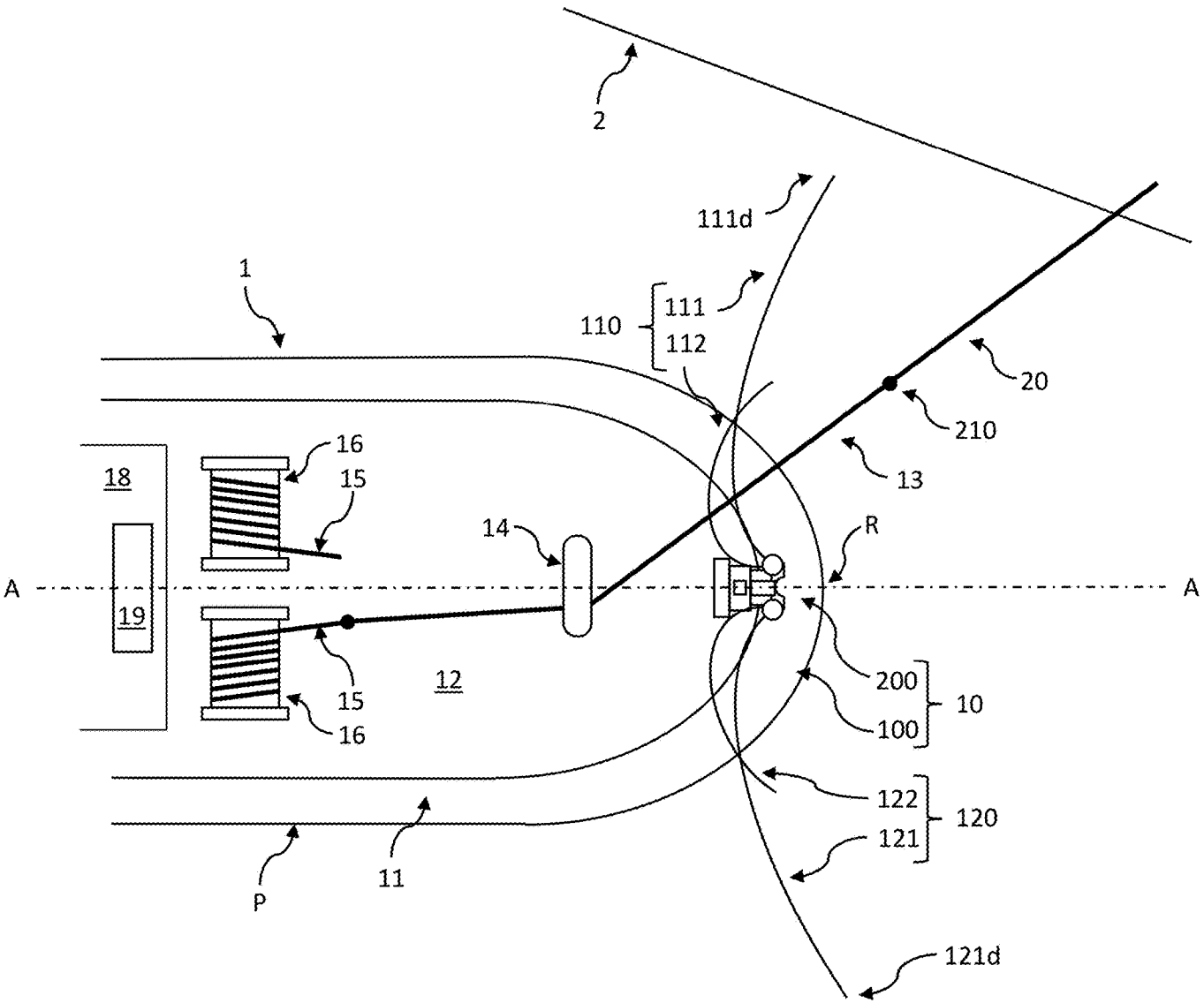
FIG. 12 shows a partial schematic top view of the tugboat of FIG. 10, in which the line handling system of the tugboat has returned to the condition shown in FIG. 4, and the lines are connected by the connector and have been removed from the coupling zone of the actuatable coupling mechanism.

The final arrangement of the connector 210 coupling the messenger line 13 and the heaving line 20 in accordance with this embodiment is shown in FIG. 11. Here it can be seen that the connector 210 is applied to the lines 13, 20 adjacent respective bends in each of the lines 13, 20. The bends in the lines 13, 20 are on the same side of the connector 210. It has been found in certain embodiments that this wire coupling arrangement can withstand about 40 kg (400 N) of force before the messenger line 13 and the heaving line 20 slip relative to each other, and that a force of approximately 5,000 N will break the connector wire 210. In other embodiments, the magnitude of one or each of these forces may be different from these figures.

When the lines 13, 20 have been coupled together, the secondary guides 112, 122 may be moved apart from each other and the guide arms 111, 121 may be moved apart from each other. This releases the heaving line 20 and coupled messenger line 13 from the space surrounded by the secondary guides 112, 122 and the hull 11, so that the messenger line 13 can be pulled up to the marine vessel 2 using the heaving line 20. Optionally thereafter, an end of at least one of the tow lines 15 can be pulled up to the marine vessel 2 using the messenger line 13, and further optionally an opposite end of the at least one of the tow lines 15 can be attached to the bitt or guide 14 of the tugboat 1.

When the line guide mechanism 100 is no longer required, in this embodiment the line guide mechanism 100 can be returned from the deployed position to the stowed position. Moreover, when the actuatable coupling mechanism 200 is no longer needed, in this embodiment the actuatable coupling mechanism 200 can be moved from the position shown in FIG. 9 onwards, at which the actuatable coupling mechanism 200 is actuatable to apply the connector 210 to the lines 13, 20 to couple together the lines 13, 20, to the position shown in FIG. 1, at which the actuatable coupling mechanism 200 is stowed. In this embodiment, the actuatable coupling mechanism 200 moves together with the line guide mechanism 100 to a stowed position within the perimeter P of the hull 11 and adjacent the deck 12, but in other embodiments this may not be the case. In some embodiments, the actuatable coupling mechanism 200 remains in position, e.g. relative to the hull 11, between uses.

While in the above described embodiments the line handling system 10 comprises the actuatable coupling mechanism 200, in some other embodiments the actuatable coupling mechanism 200 may be omitted so that the line handling system 10 is free from an actuatable coupling mechanism.

While in the above described embodiments the line guide mechanism 100 is movable relative to the hull 11 to an operation position at which the line guide mechanism 100 is for guiding movement of a portion of a line of the tugboat towards a predetermined region of the perimeter, in other embodiments the line guide mechanism 100 is not movable relative to the hull 11 to an operation position at which the line guide mechanism 100 is for guiding movement of a portion of a line of the tugboat towards a predetermined region of the perimeter. For example, the line guide mechanism 100 may be immovable from the deployed position relative to the hull 11.

In other embodiments, two or more of the above described embodiments may be combined. In other embodiments, features of one embodiment may be combined with features of one or more other embodiments.

Embodiments of the present invention have been discussed with particular reference to the examples illustrated. However, it will be appreciated that variations and modifications may be made to the examples described within the scope of the invention.

What is claimed is:

1. A line handling system for locating on a tugboat, wherein the tugboat is for assisting a marine vessel to maneuver and the tugboat comprises a hull having a perimeter;

wherein the line handling system comprises a line guide mechanism that protrudes, or is positionable to protrude, away from the hull for guiding a line of the marine vessel towards a predetermined region of the perimeter, when the line handling system is located on the tugboat wherein the line guide mechanism comprises at least one guide device, each of the at least one guide device comprising a guide arm that protrudes, or is positionable to protrude, away from the hull when the line handling system is located on the tugboat, and wherein the or each guide device comprises a secondary guide that is movable relative to the guide arm of the respective guide device to drive the line along the guide arm of the respective guide device towards the predetermined region of the perimeter, when the line handling system is located on the tugboat.

2. The line handling system of claim 1, wherein the line handling system comprises an actuatable coupling mechanism for coupling the line of the marine vessel to a second line when the line of the marine vessel is at the predetermined region of the perimeter, when the line handling system is located on the tugboat.

3. The line handling system of claim 2, wherein the actuatable coupling mechanism is for coupling the line of the marine vessel to the second line by applying a connector to the line of the marine vessel and the second line.

4. The line handling system of claim 1, wherein the line handling system comprises a line engager for engaging with the line of the marine vessel when the line of the marine vessel is at the predetermined region of the perimeter.

5. The line handling system of claim 1, wherein the guide arm is movable relative to the hull when the line handling system is located on the tugboat.

6. The line handling system of claim 1, wherein the at least one guide device comprises first and second such guide devices.

7. The line handling system of claim 6, wherein the first and second such guide devices are arranged so that the respective guide arms of the first and second guide devices are movable towards and away from each other.

8. The line handling system of claim 1, wherein the secondary guide is rotatable relative to the guide arm of the respective guide device to drive the line along the guide arm of the respective guide device towards the predetermined region of the perimeter, when the line handling system is located on the tugboat.

9. The line handling system of claim 1, wherein the at least one guide device comprises first and second guide devices arranged so that the respective secondary guides of the first and second guide devices are movable towards each other and relative to the hull, when the line handling system is located on the tugboat.

10. The line handling system of claim 9, wherein, during movement of the respective secondary guides of the first and second guide devices relative to the hull, when the line handling system is located on the tugboat, the secondary guides cross over each other at a cross over point that moves along one or both of the secondary guides.

11. The line handling system of claim 5, wherein the line guide mechanism comprises a drive mechanism for driving movement of the guide arm relative to the hull, when the line handling system is located on the tugboat.

12. The line handling system of claim 7, comprising a drive device for driving movement of the secondary guide relative to the hull and the guide arm of the respective guide device, when the line handling system is located on the tugboat.

13. A tugboat for assisting a marine vessel to maneuver, the tugboat comprising:

a hull having a perimeter; and a line handling system comprising a line guide mechanism that protrudes, or is positionable to protrude, away from the hull for guiding a line of the marine vessel towards a predetermined region of the perimeter, wherein the line guide mechanism comprises at least one guide device, each of the at least one guide device comprising a guide arm that protrudes, or is positionable to protrude, away from the hull, and wherein the or each guide device comprises a secondary guide that is movable relative to the guide arm of the respective guide device to drive the line along the guide arm of the respective guide device towards the predetermined region of the perimeter.

14. The tugboat of claim 13, wherein the guide arm is rotatable relative to the hull about a pivot point so as to move an end of the guide arm distal to the pivot point towards and away from an axis that extends in a fore and aft direction of the tugboat.

15. The tugboat of claim 13, wherein the line guide mechanism is movable relative to the hull between a deployed position, at which the line guide mechanism protrudes away from the hull for guiding the line of the marine vessel towards the predetermined region of the perimeter, and a stowed position, at which the line guide mechanism does not protrude away from the hull or protrudes away from the hull to a lesser extent than in the deployed position.

16. The tugboat of claim 13, wherein the line guide mechanism is movable relative to the hull to an operation position, at which the line guide mechanism is for guiding movement of a portion of a line of the tugboat towards the predetermined region of the perimeter.

17. The tugboat of claim 16, wherein the line handling system comprises an actuatable coupling mechanism for coupling the line of the marine vessel to a second line when the line of the marine vessel is at the predetermined region of the perimeter, and wherein the second line is the line of the tugboat.

18. The tugboat of claim 13, wherein the line handling system is movable relative to the hull so as to vary the predetermined region of the perimeter towards which the line guide mechanism is able to guide the line of the marine vessel.

* * * * *